United States Patent [19]

Van Zandt

[11] Patent Number: 4,462,764

[45] Date of Patent: Jul. 31, 1984

[54] HYDRAULIC LONG STROKE PUMP

[76] Inventor: Hillard C. Van Zandt, 407 S. Grant, Odessa, Tex. 79763

[21] Appl. No.: 320,577

[22] Filed: Nov. 12, 1981

[51] Int. Cl.[3] ..... F04B 17/00

[52] U.S. Cl. ..... 417/401; 417/403

[58] Field of Search ..... 417/397, 398, 399, 393, 417/400, 401, 403, 404, 533

[56] References Cited

U.S. PATENT DOCUMENTS

| | | | |
|---|---|---|---|
| 5,352 | 11/1847 | Boardman, Jr. | 417/404 |
| 294,859 | 3/1884 | Dickie | 417/403 |
| 655,232 | 8/1900 | Heisler | 417/533 |
| 2,283,207 | 5/1942 | Hollander | 417/393 X |
| 2,495,669 | 1/1950 | Cannon | 417/401 X |
| 2,540,347 | 2/1951 | Pounds | 417/383 X |
| 2,887,955 | 5/1959 | Owen | 417/404 |

FOREIGN PATENT DOCUMENTS

| | | | |
|---|---|---|---|
| 34548 | 9/1929 | France | 417/401 |

*Primary Examiner*—Leonard E. Smith

*Attorney, Agent, or Firm*—Sixbey, Friedman & Leedom

[57] ABSTRACT

A hydraulically powered long stroke pumping unit including support means with a first pump unit mounted on said support means. The first pumping unit includes a first pump cylinder and first piston means reciprocable in said first pump cylinder and a piston rod extending outwardly from said first pump cylinder. A second pump unit is mounted on the support means in opposed aligned, spaced relationship with said first pump unit, and the second pump unit includes a second pump cylinder and a second piston means reciprocable in the second pump cylinder. The second piston means includes a piston rod extending outwardly from the second pump cylinder toward the piston rod of the first pump cylinder. The piston rods extend toward one another along a common central longitudinal axis, and a pump drive bar is connected to the outermost ends of the piston rods. A hydraulic drive means is connected to selectively and positively drive the pump drive bar in opposite directions in a single plane.

7 Claims, 5 Drawing Figures

PUMP
OIL COOLER
STRAINER
HYDRAULIC STORAGE TANK
72
TO 82
TO 82

HYDRAULIC LONG STROKE PUMP

TECHNICAL FIELD

The present invention relates generally to hydraulic powered pumping units, and more particularly to a highly efficient, high volume, long stroke hydraulically powered pumping unit particularly adapted for oil well mud pumping uses.

BACKGROUND ART

Recent activity in oil field exploration in response to an increased demand for the exploitation of additional sources of petroleum beyond those currently known and used has led in the establishment of oil wells in remote locations. This has resulted in a need for more versatile and efficient equipment for use at a well head which may be easily and conveniently serviced. A primary deficiency of many currently known pumping and drilling units for oil field use is the fact that such units may not be rapidly and conveniently serviced with replacable components which permit the unit to be placed back into operation after a minimum "down time".

One extremely important assembly used during the drilling of wells by the rotary method is a mud pump for circulating drilling mud downwardly to the drill bit and upwardly outside the drill pipe to the surface. Mud pumps are required to provide drilling mud under relatively high pressures and volume to handle fluid containing a considerable amount of abrasive material. This combination results in a high degree of pump wear which is often accentuated by the design of existing pumps and pump drives. For example, known gear driven mud pump units experience excessive gear wear in the drive between a driving engine and the pump which necessitates frequent replacement of the gear drive, a maintenance feature which is both time consuming and expensive. Such gear driven units, as well as prior known hydraulic units, employ a very short stroke with a high piston speed in order to provide the required volume of pressurized drilling mud, and the resulting passage of abrasive fluid through the pump cylinders causes the rapid abrasion of cylinder liners. Also, with short stroke pumps, rapid piston reversal causes pounding of the drilling mud control valves as well as an extremely high number of valve actuations per unit of time. These factors all result in excessive wear and high maintenance requirements which are not acceptable at remote drilling locations.

In the past, it has been recognized that the deficiencies of existing drilling mud pumps could be substantially rectified by the development of a long stroke hydraulic pump which would provide smooth operation and relatively few reversals per minute. However, with a single cylinder pump, the long piston rods required to provide a long, slow stroke have a tendency to buckle under compression, and this has inhibited the development of such pumps. In an attempt to develop a slower stroke pump and eliminate rapid valve actuation, coaxial cylinder pumps with a single piston rod and dual pistons have been developed wherein motive fluid is centrally applied to the coaxial piston structure. This motive fluid is selectively supplied to either one pump cylinder or another to control the direction of piston movement. A coaxial pump system of this type is disclosed by U.S. Pat. No. 2,283,207 to A. Hollander, and although such units do provide a slower stroke pumping action than conventional short stroke units, these units are not designed for effective component replacement, nor do they provide a high volume, high pressure output with a minimal horse power input. Also the pump action and the pump drive are occurring in the same cylinders which is undesirable.

Consequently, a need exists for an effective drill mud pumping unit which may be easily shipped and transported to remote oil fields, readily and quickly errected at a well head by a minimal work crew to form a very stable supporting structure for the pumping apparatus, and which includes features whereby the unit will function at optimum efficiency with a low stroke speed and high volume.

DISCLOSURE OF THE INVENTION

It is a primary object of the present invention to provide a hydraulic, long stroke pumping unit formed from components which are easily accessible and readily replaced during pump maintenance.

It is another object of the present invention to provide a novel and improved hydraulic long stroke pumping unit which incorporates an effective hydraulic control system to provide positive activation of a plurality of opposed hydraulic drive cylinders for the pump. This drive system also includes a novel manifold system incorporated in the pump structure and the hydraulic circuit to remove heat from the hydraulic drive fluid.

It is a further object of the present invention to provide a novel and improved hydraulic long stroke pumping unit including speed, opposed pump cylinders having aligned pump rods positively driven by a horizontally disposed central pump drive bar. This pump drive bar is powered by a plurality of opposed hydraulic driving units mounted in symmetrical spaced relationship on opposite sides of the pump pistons. These hydraulic driving units all positively power the drive bar through the stroke cycle thereof.

It is yet an additional object of the present invention to provide a novel and improved hydraulic long stroke pumping unit which includes opposed, aligned spaced pump cylinders centrally located between opposed, aligned spaced hydraulic drive units. The hydraulic drive units adjacent each pump cylinder are symmetrically located on either side of the pump cylinder and include drive rods which are connected, with the pump rods, to a horizontal centrally located pump drive bar. The outer ends of the pump drive bar are positively supported in an elongated bearing guide to positively preclude any vertical or side movement of the pump drive bar. This in turn prevents any buckling or misalignment of the hydraulic cylinder drive rods or the pump rods.

It is still another object of the present invention to provide a novel and improved hydraulic long stroke pumping unit having spaced, aligned but opposed pump cylinders and hydraulic drive cylinders. The combined volume of the hydraulic drive cylinders employed in combination with a single pump cylinder is normally equal to at least half the volume of the pump cylinder, thereby permitting effective pump cylinder drive with lower volume hydraulic cylinders.

Other objects and advantages of the present vention will become apparent from a review of the following description and claims taken in conjunction with the accompanying drawings.

In accordance with the aforesaid objects, the present invention provides a hydraulically powered long stroke pumping unit which includes an elongated, horizontally disposed support assembly having mounting means at either end thereof for removably mounting a centrally disposed pump cylinder and at least two symmetrically oriented drive cylinders on either side of the pump cylinder. The drive cylinders and the pump cylinder all include reciprocable piston rods extending outwardly therefrom, and the ends of all such rods are secured to a horizontally disposed pump drive bar. The outward ends of the pump drive bar are mounted in a bearing guide secured to the support assembly which supports the pump drive bar during reciprocal movement thereof and prevents movement of the drive bar in any direction other than two opposed directions of reciprocation. A hydraulic control system for the drive cylinders operates to cause the pump drive bar to be positively driven in two directions in a single plane, and a cooling manifold for hydraulic drive fluid is incorporated in the hydraulic control system and mounted on the support assembly.

BEST MODE FOR CARRYING OUT THE INVENTION

Figure 1:
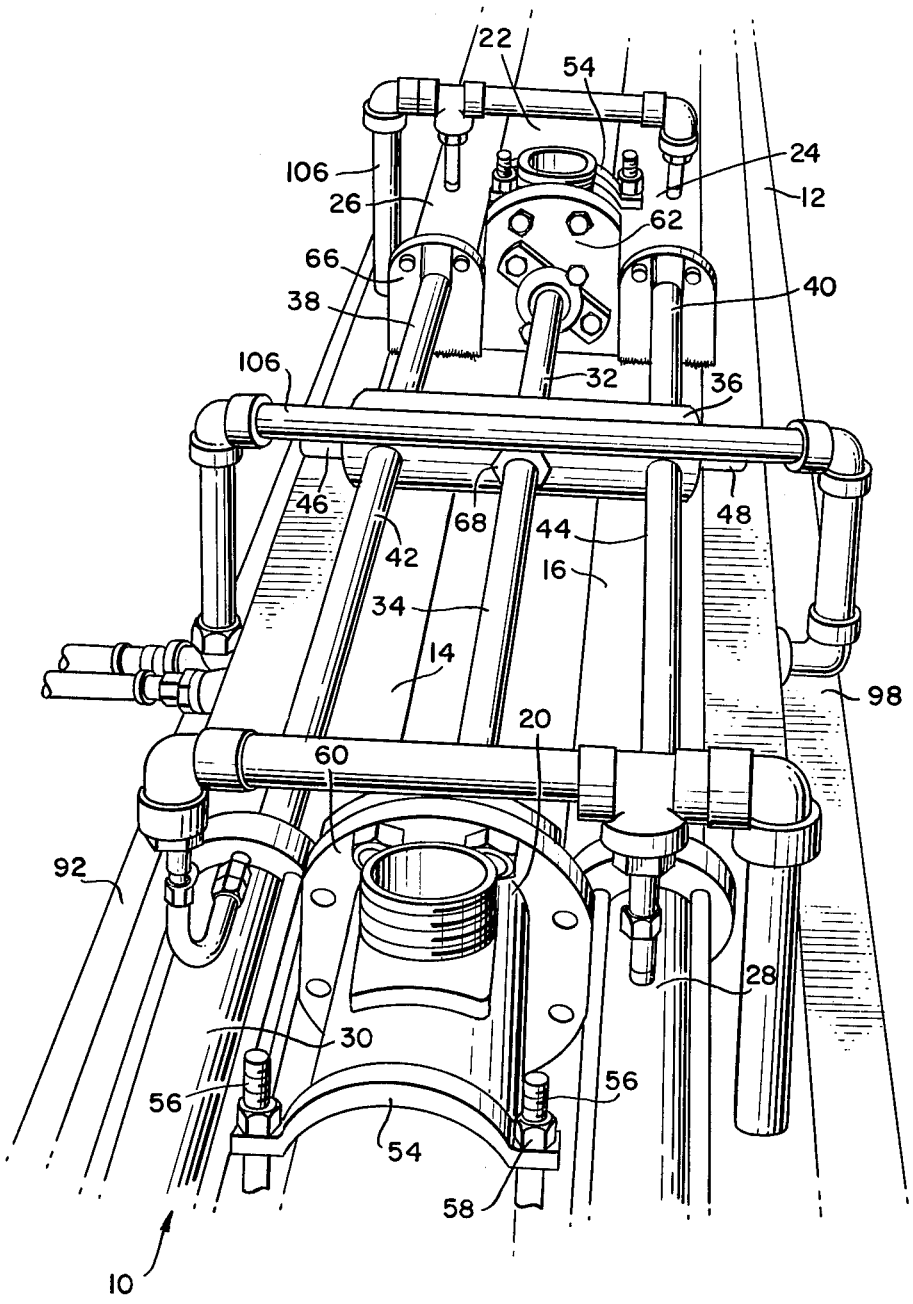
FIG. 1 is a perspective plan view of the long stroke hydraulic pump of the present invention.

Referring now to the drawings, the hydraulic long stroke pump of the present invention indicated generally at 10 includes an elongated support structure 12 which extends for the full length of the pump. This support structure includes two substantially parallel, spaced beams 14 and 16 joined by a plurality of cross-beams 18.

Secured in spaced relationship at either end of the support structure 12 are pump cylinders 20 and 22 and hydraulic drive cylinders 24,26,28 and 30. The pump cylinders 20 and 22 are provided with internal pistons conventional to such pumps, and have piston rods 32 and 34 respectively extending therefrom. The pump cylinders are aligned in spaced relationship on support 12 so that the piston rods 32 and 34 extend in aligned relationship along the same central axis to a horizontally disposed central pump drive bar 36.

Similarly, the hydraulic drive cylinders 24 and 26, which are mounted in equal spaced relationship on either side of the pump cylinder 22, are provided with drive rods 38 and 40, while the hydraulic drive cylinders 28 and 30, which are mounted in equal spaced relationship on either side of the pump cylinder 20, are provided with drive rods 42 and 44. The drive rods 38 and 40 extend in parallel spaced relationship with the piston rod 32, and the central axis of the drive rods is in the same plane as the central axis of the piston rod. Similarly, the drive rods 42 and 44 extend in parallel spaced relationship to the piston rod 34, and the central axis of the drive rods are in the same plane as the central axis of the piston rod. Thus, the drive rods 38 and 42 are secured to opposite sides of the drive bar 36 along the same central axis, the piston rods 32 and 34 are secured to opposite sides of the drive bar along the same central axis, and the drive rods 44 and 48 are secured to opposite sides of the drive bar along the same central axis. This is extremely important, for if any misalignment occurs, undue wear of the drive cylinder and piston cylinder seals will result.

To insure that the pump cylinder piston rods and hydraulic drive cylinder rods are maintained in alignment with no sagging or buckling during the operation of the pump 10, the opposed outer ends of the pump drive bar 36 are provided with stub shafts 46 and 48. A suitable rotary bearing structure is mounted upon each of these stub shafts, and the shafts extend into an elongated bearing guide 50 which is mounted on either side of the support 12. The elongated bearing guide includes a central slot or track 52 which receives the adjacent stub shaft. This slot extends for a distance equal to the maximum extent of travel of the drive bar 36 and operates to prevent any movement of the drive bar either upwardly, downwardly or side ways, other than in the plane of movement of the piston rods and drive rods.

The pump cylinders 20 and 22 and the hydraulic drive cylinders 24,26,28 and 30 may be easily removed from the support 12 and either replaced or repaired. The pump cylinders are secured in place on the support 12 by hold down clamps 54 which are clamped in place on tie rods 56 extending upwardly from the cross beams 18. The upper ends of the tie rods are threaded to receive clamping nuts 58. Additionally, the forward end of each pump cylinder is provided with a flange 60 which is bolted to a mounting plate 62 secured to a support cross beam 18.

The hydraulic drive cylinders 24, 26, 28 and 30 are also mounted upon the support 12 for simple and effective removal therefrom. The rod ends of each drive cylinder are provided with a flange 64 which is bolted to a U-shaped mount 66 which extends upwardly from a support structure cross beam 18. Similarly, the head end of each drive cylinder is also provided with a flange similar to the flange 64 which is bolted to another support similar to the support 66 which extends upwardly from a cross beam 18. Since the ends of the piston rods 32 and 34 and drive rod 38,40,42 and 44 are removably secured to the drive bar 36 by nuts 68 or other securing means, it will be apparent that any pump or drive cylinder may be easily removed by disconnecting the rod therefor and then releasing the cylinder from the support 12.

Figures 3, 4A, 4B:
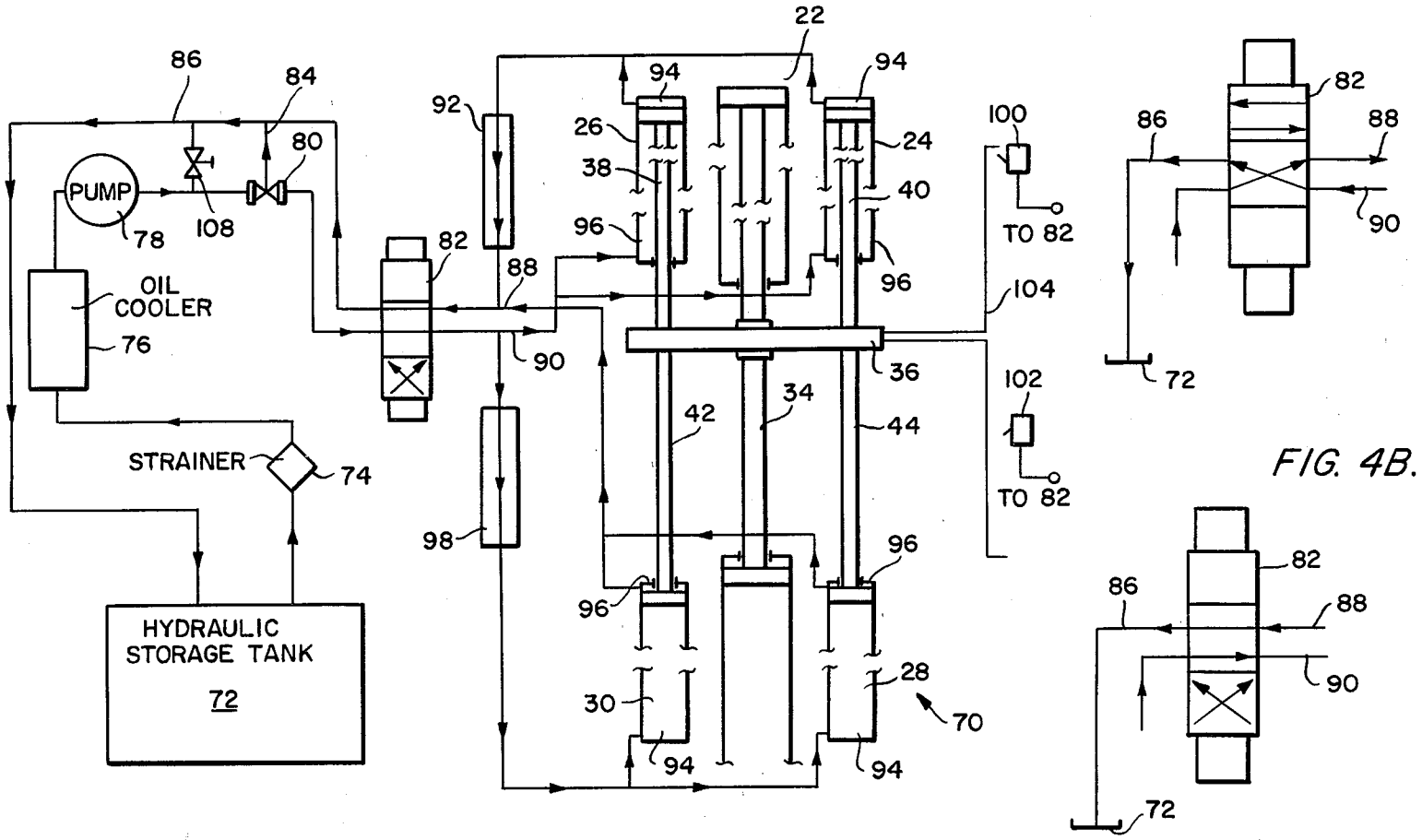
FIG. 3 is a hydraulic circuit diagram of the hydraulic control circuit for the pump of FIG. 1.
FIGS. 4A and B are diagramatic illustrations showing the operation of the solenoid control valve for the hydraulic circuit of FIG. 3.

Referring now to FIGS. 3 and 4, the hydraulic control system 70 for the hydraulic long stroke pump 10 includes a storage tank 72 which provides hydraulic fluid through a strainer 74 and a cooler 76 to a pump 78. The pump 78 provides fluid under pressure through a pressure relief valve 80 to an electrical solenoid control valve 82. If the pressure of the hydraulic fluid from the pump 78 becomes too great on the control valve 82, a pressure relief valve 80 passes the fluid across a shunt line 84 and into a return line 86 which returns the fluid to the storage tank 72.

The solenoid control valve 82 controls the provision of hydraulic fluid under pressure to either the head or rod ends of the hydraulic drive cylinders 24,26,28 and 30. Referring to FIG. 4A, the solenoid valve 82 is shown in the neutral or fluid blocking position wherein hydraulic fluid from the pump 78 is directed back to the tank 72.

In the FIG. 4B position of the solenoid valve 82, hydraulic fluid from the pump 78 is provided to a line 88 and is returned to the valve on a line 90. The fluid under pressure on the line 88 passes through a cooling manifold 92 and directly into the head ends 94 of the drive cylinders 24 and 26. Simultaneously, the fluid from the line 88 passes directly into the rod ends 96 of the drive cyinders 28 and 30. Thus, it will be noted that the drive rods 38 and 40 positively drive the drive bar 36 downwardly in FIG. 3, while the drive rods 42 and 44 positively pull the drive bar downwardly. Since the drive bar 36 is moved by a combination of pushing and pulling drive rods, the drive rods are not subjected to a compression which would tend to buckle the rods. Simultaneously, the fluid is evacuated from the head ends 94 of the drive cylinders 28 and 30 and passed through a cooling manifold 98 to the line 90, while fluid is evacuated from the rod ends of the drive cylinders 24 and 26 and directed to the line 90. This fluid from the line 90 then passes through the valve 82 to the return line 86 and the storage tank 72.

When the solenoid valve 82 is switched to the position illustrated in FIG. 3, hydraulic fluid under pressure from the pump 78 is directed along the line 90 to the rod ends 96 of the drive cylinders 24 and 26 and to the head ends 94 of the drive cylinders 28 and 30. At the same time, fluid is evacuated to the line 88 from the rod ends 96 of the drive cylinders 28 and 30 and the head ends 94 of the drive cylinders 24 and 26. This causes the pump drive bar 36 to be driven in the opposite direction toward the top of the page in FIG. 3. It will be noted that as the pump drive bar reciprocates, the pump piston rods 32 and 34 are also reciprocated to cause a smooth pumping action within the pump cylinders 20 and 22. In a manner known to the art, the head ends of these pump cylinders may be connected to mud valve heads (not shown) which contain valves for controlling the inflow and outflow of drilling mud.

The solenoid valve 82 is controlled in the manner described to cause reciprocation of the drive bar 36 by a limit switch system shown diagrammatically as switches 100 and 102. These switches determine the extent of the stroke of the drive rods 38,40,42 and 44 and operate to change the position of the solenoid valve 82 between that shown in FIG. 3 and FIG. 4B. Any suitable switch actuator 104 can be provided to selectively activate one of the switches 100 and 102 when the desired extent of the stroke for the drive rods is reached. For example, as shown in FIG. 3, the switch actuator might be connected to the drive bar 36, or, the switches may be positioned within the bearing guide for the drive bar and directly activated by the stub end of the drive bar. Obviously, the separately shown switches 100 and 102 might constitute a single three-way switch to control the solenoid valve 82. A separate on/off switch, not shown, might also be employed to switch the solenoid valve to the position shown in FIG. 4A.

Figure 2:
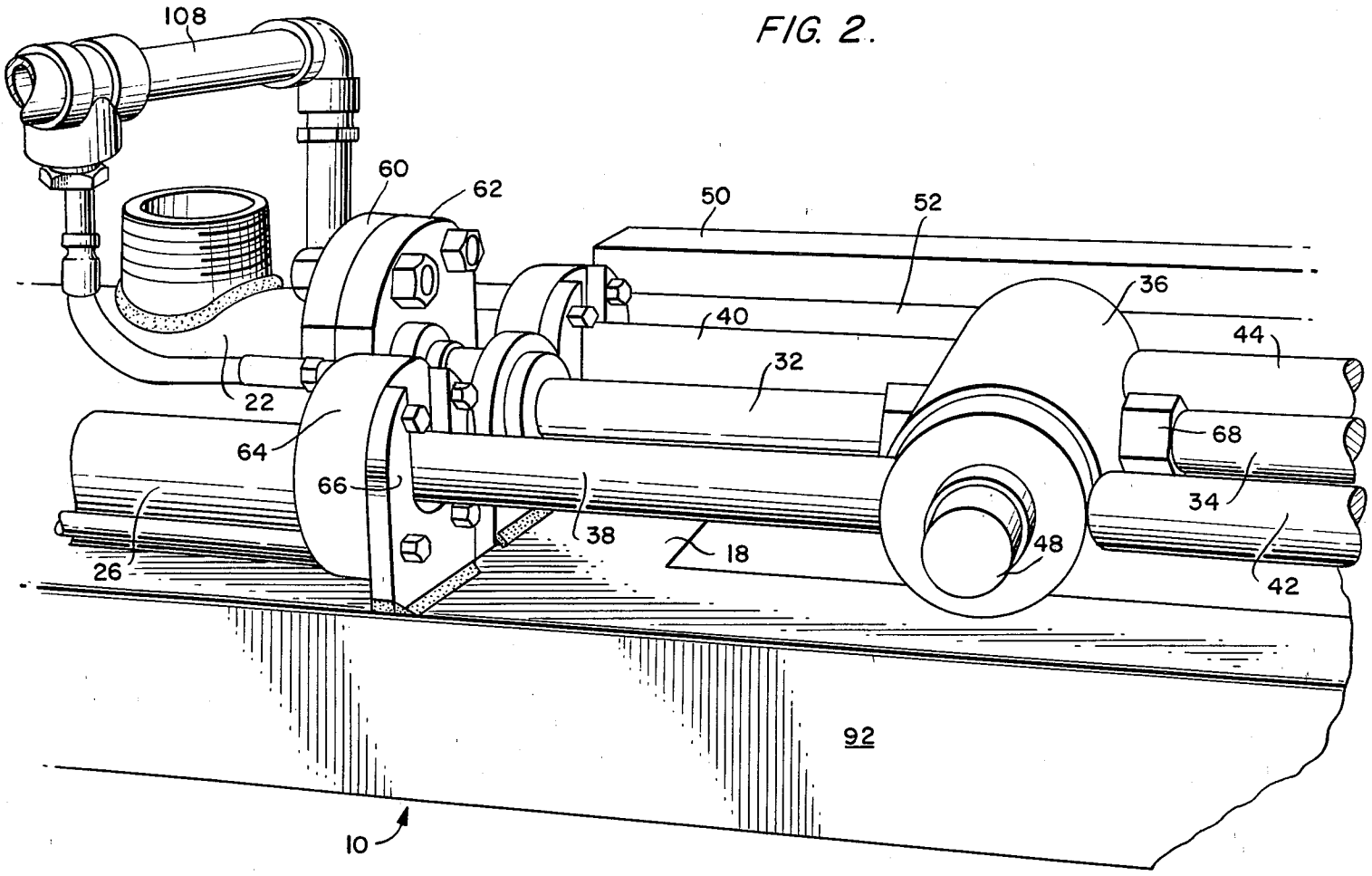
FIG. 2 is a perspective view of a portion of the pump of FIG. 1.

In a large, long stroke pump typified by the pump 10 wherein the fluid within the hydraulic system 70 is subjected to extremely high pressures, it has been found that the hydraulic fluid reaches very high temperatures and is difficult to cool. This problem has been alleviated in the hydraulic system of FIG. 3 by passing the fluid through cooling manifolds 92 and 98. These cooling manifolds constitute a novel portion of the pump support 12, and with reference to FIGS. 1 and 2, it will be noted that the cooling manifolds extend on either side of the support for the full length of the pump. These manifolds consist of elongated hollow metal beams which are sealed at both ends to enable the manifolds to receive and contain hydraulic fluid. These elongated metal beams conduct the heat from the hydraulic fluid to the outside atmosphere. Overhead conduits, indicated generally at 106, extend between the manifolds 92 and 98 and the hydraulic drive cylinders 24,26,28 and 30. The conduits constitute a connecting portion of the hydraulic circuit shown in FIG. 3.

INDUSTRIAL APPLICABILITY

The long stroke hydraulic pump 10 of the present invention operates effectively with the low horse power input necessary to drive the hydraulic pump 78 and provides a high pressure output in the pump cylinders 20 and 22. Driving force for the pump is supplied by separate drive cylinders 24,26,28 and 30 which all simultaneously provide a positive drive to the pump drive bar 36 throughout the extent of the drive bar stroke. Although only two drive cylinders are illustrated for each pumping cylinder in FIGS. 1 and 2, any number of drive cylinders symmetrically arranged on either side of the pump cylinder and having drive rods connected to the central drive bar may be employed. For optimum drive efficiency, the total volume of all drive cylinders positioned adjacent a single pump cylinder should be one half the volume of the pump cylinder.

When mud valve heads are secured to the head ends of the pump cylinders 20 and 22, the long stroke pump 10 operates effectively as a high volume drilling mud pump. The speed of the pump may be controlled by a manual speed valve 108 in the hydraulic circuit 70 which selectively shunts fluid from the hydraulic pump 78 back to the return line 86. Since the hydraulic drive for the pump is entirely separate from the pumping cylinders 20 and 22, the high pressure drive system is not subjected to the abrasive fluid to which the pump cylinders are subjected. However, any malfunction of either a drive or pump cylinder is easily rectified by cylinder removal and repair or replacement.

I claim:

1. A hydraulically powered long stroke pumping unit comprising support means including a base and at least first and second mounting means secured to said base and extending substantially normal thereto in relative spaced relationship, a first pump unit removably mounted on said support means and including a first pump cylinder and first piston means reciprocable in said first pump cylinder, means removably securing a first end of said first pump cylinder to said first mounting means, said first piston means including a piston rod extending outwardly from said first end of said first pump cylinder, a second pump unit removably mounted on said support means in opposed aligned, spaced relationship with said first pump unit, said second pump unit including a second pump cylinder and second piston means reciprocable in said second pump cylidner, said second piston means including a piston rod extending outwardly from a first end of second pump cylinder, means removably securing said first end of said second pump cylinder to said second mounting means, said first and second pump cylinders being mounted with the piston rods thereof extending toward one another along a common central longitudinal axis, a pump drive bar removably connected to the outermost ends of the piston rods of said first and second pump cylinders, and hydraulic drive means connected to selectively and positively drive said pump drive bar in opposite directions in a single plane.

2. The hydraulically powered long stroke pumping unit of claim 1 which includes tie down mounting means secured to said base and said first and second pump cylinders, said tie down mounting means operating to removably secure said first and second pump cylinders to said base.

3. The hydraulically powered long stroke pumping unit of claim 1, wherein said base extends beneath said first and second pump units and said hydraulic means, said hydraulic drive means including at least a first plurality of paired hydraulic driving means removably mounted on said support means adjacent said first pump cylinder, said first plurality of paired hydraulic driving means including a first hydraulic cylinder and cylinder rod mounted on one side of said first pump cylinder and a second hydraulic cylinder and cylinder rod mounted on the opposite side of said first pump cylinder, said cylinder rods for said first and second hydraulic cylinders having a central longitudinal axis in the plane of the central longitudinal axis of the piston rod of said first pump cylinder and extending in parallel equal spaced relationship thereto, the outer ends of said cylinder rods for the first and second hydraulic cylinders being removably connected to said pump drive bar, and a second plurality of paired hydraulic driving means removably mounted on said support means adjacent said second pump cylinder, said second plurality of paired hydraulic driving means including a third hydraulic cylinder and cylinder rod mounted on one side of said second pump cylinder and a fourth hydraulic cylinder and cylinder rod mounted on the opposite side of said second pump cylinder, said cylinder rods for the third and fourth hydraulic cylinders having a central longitudinal axis in the plane of the central longitudinal axis of the piston rod of said second pump cylinder and extending in parallel equal spaced relationship thereto, the outer ends of said cylinder rods for the third and fourth hydraulic cylinders being removably connected to said pump drive bar, said support means including cylinder mounting means for removably securing said first, second, third and fourth hydraulic cylinders to said base.

4. The hydraulically powered long stroke pumping unit of claim 3, wherein the combined volume of the hydraulic cylinders of said first plurality of paired hydraulic driving means is equal to at least one half the volume of said first pump cylinder and the combined volume of the hydraulic cylinders of said second paired plurality of hydraulic means is equal to at least one half the volume of said second pump cylinder.

5. The hydraulically powered long stroke pumping unit of claim 3, wherein said first, second, third and fourth hydraulic cylinders include a rod end and a head end, said hydraulic drive means including hydraulic fluid supply circuit means for providing hydraulic fluid under pressure to said first, second, third, and fourth hydraulic cylinders, said fluid supply circuit means operating to simultaneously supply hydraulic fluid to the rod ends of two adjacent hydraulic cylinders and the head ends of the two remaining opposed hydraulic cylinders during one half of the stroke cycle of said pump drive bar.

6. The hydraulically powered long stroke pumping unit of claim 3, wherein said hydraulic drive means includes hydraulic fluid supply circuit means for providing hydraulic fluid under pressure to said first and second plurality of paired hydraulic driving means, said hydraulic fluid supply circuit causing each of said plurality of paired hydraulic driving means to simultaneously and positively drive said pump drive bar throughout the stroke cycle thereof.

7. The hydraulically powered long stroke pumping unit of claim 3, which includes tie down mounting means secured to said base and said first and second pump cylinders, said tie down mounting means operating to removably secure said first and second pump cylinders to said base, the cylinder mounting means for each said first, second, third and fourth hydraulic cylinders including a pair of mounts secured to said base and extending substantially normal thereto in relative spaced relationship, said mounts being spaced to engage opposite ends of a respective one of said hydraulic cylinders and securing means for removably securing the ends of a hydraulic cylinder to the mounts in engagement therewith.

* * * * *